US009153887B2

(12) United States Patent
Chen

(10) Patent No.: US 9,153,887 B2
(45) Date of Patent: Oct. 6, 2015

(54) ELECTRICAL CONNECTOR AND COMBINATION THEREOF

(71) Applicant: OUPIIN ELECTRONIC (KUNSHAN) CO., LTD, Kunshan, Jiangsu (CN)

(72) Inventor: Hsin Chih Chen, Jiangsu (CN)

(73) Assignee: OUPIIN ELECTRONIC (KUNSHAN) CO., LTD, Kunshan, Jiangsu (CN)

( * ) Notice: Subject to any disclaimer, the term of this patent is extended or adjusted under 35 U.S.C. 154(b) by 192 days.

(21) Appl. No.: 14/020,907

(22) Filed: Sep. 9, 2013

(65) Prior Publication Data

US 2014/0104781 A1 Apr. 17, 2014

(30) Foreign Application Priority Data

Oct. 16, 2012 (CN) ..... 2012 1 0391698

(51) Int. Cl.
*H01R 12/70* (2011.01)

(52) U.S. Cl.
CPC ..... *H01R 12/7088* (2013.01)

(58) Field of Classification Search
CPC ..... H01R 12/7088
See application file for complete search history.

(56) References Cited

U.S. PATENT DOCUMENTS

| | | | | |
|---|---|---|---|---|
| 5,993,259 | A * | 11/1999 | Stokoe et al. | 439/607.09 |
| 6,394,818 | B1 * | 5/2002 | Smalley, Jr. | 439/79 |
| 6,592,381 | B2 * | 7/2003 | Cohen et al. | 439/80 |
| 6,905,367 | B2 * | 6/2005 | Crane et al. | 439/607.01 |
| 6,975,511 | B1 * | 12/2005 | Lebo et al. | 361/703 |
| 7,001,189 | B1 * | 2/2006 | McGowan et al. | 439/79 |
| 7,104,812 | B1 * | 9/2006 | Bogiel et al. | 439/79 |
| 8,662,923 | B2 | 3/2014 | Wu | |
| 2002/0193019 | A1 * | 12/2002 | Blanchfield et al. | 439/857 |
| 2003/0219999 | A1 * | 11/2003 | Minich et al. | 439/79 |
| 2006/0281354 | A1 * | 12/2006 | Ngo et al. | 439/290 |
| 2007/0197063 | A1 * | 8/2007 | Ngo et al. | 439/108 |
| 2007/0293084 | A1 * | 12/2007 | Ngo | 439/552 |
| 2009/0197466 | A1 * | 8/2009 | Cheng et al. | 439/589 |
| 2012/0164892 | A1 * | 6/2012 | Ke et al. | 439/676 |
| 2013/0109224 | A1 * | 5/2013 | Chin et al. | 439/485 |
| 2014/0104781 | A1 * | 4/2014 | Chen | 361/679.41 |
| 2014/0206241 | A1 * | 7/2014 | Chen | 439/676 |

FOREIGN PATENT DOCUMENTS

| | | |
|---|---|---|
| CN | 201194259 | 2/2009 |
| TW | 420093 | 1/2012 |

* cited by examiner

*Primary Examiner* — James Harvey
(74) *Attorney, Agent, or Firm* — Soroker-Agmon

(57) ABSTRACT

An electrical connector and combination thereof are provided in the present invention. The electrical connector combination includes a first electrical connector being parallelly mounted on a first circuit board and a second electrical connector being perpendicular mounted on a second circuit board. The first circuit board is perpendicular to the second circuit board. The first electrical connector disposes at least one row vertical power port and one row vertical signal port. The signal port is parallel to the power port. The second electrical connector forms at least one row long power slot and at least one row long signal slot. The signal slot is parallel to the power slot. When docking, there forms an electrical contact between the plug power terminal and the corresponding receptacle power terminal, and forms an electrical connection between the plug signal terminal and the receptacle signal terminal.

9 Claims, 12 Drawing Sheets

ELECTRICAL CONNECTOR AND COMBINATION THEREOF

BACKGROUND OF THE INVENTION

1. Field of the Invention

The present invention relates to an electrical connector technical field, and particularly relates to a power and signal mixed compact electrical connector and the combination thereof.

2. Description of Prior Art

An electrical connector is provided with electrical features of robust and convenient, and is suitable for various industrial and commercial applications such as, for example, in a power source, a server, a router, a memory storage, an industrial controller and a modular chassis etc. . . . In the meanwhile, since several terminal configurations can be designed in the connector, applications of power source, signal and the combination thereof can be satisfied.

At present, there are a great many of manufacturers striving to introduce electrical connectors that are designed power and signal mixed, yet the common ones are low-rise mixed electrical connectors whose height coverage is relatively small but whose design of a pro-longed shape takes too much edge of the circuit board, and as there is limited edge of a circuit board, no more numbers of other types of connectors can be included. Therefore, this sort of low-rise mixed electrical connectors is only applicable in an electronic device that has a strict control on the height of electrical connector and is unable to satisfy an electronic device which requires scalability on the edge of a circuit board.

As a result, in the light of the defects and inconvenience in the described conventional electrical connectors, a new electrical connector shall be designed, which is provided with power and signal terminals that are designed to satisfy the requirement of DC power supply. In the innovative electrical connector, the configuration of power and signal terminals are re-designed, the structure is properly optimized, thereby settling the problems in the abovementioned conventional technology.

SUMMARY OF THE INVENTION

One objective of the present invention is to provide an electrical connector having a plug body, and power terminal and signal terminal that are mounted into the plug body, the arrangement of the power terminal and signal terminal of the electrical connector is compact, and can save the edge space of a circuit and improve the system air circulation of the power system of the electrical connector, thereby providing a power transmission and distribution of high efficiency.

Another objective of the present invention is to provide an electrical connector having a receptacle body, and power terminal and signal terminal that are mounted into the receptacle body, the arrangement of the power terminal and signal terminal of the electrical connector is compact, and can save the edge space of a circuit and improve the system air circulation of the power system of the electrical connector, thereby providing a power transmission and distribution of high efficiency.

A third objective of the present invention is to provide an electrical connector combination including a first electrical connector and a second electrical connector, whereby forming a reliable mechanical and electrical connection which is structurally compact, also the electrical connector combination can provide a power transmission and distribution of high efficiency.

Other objectives and advantages of the present invention are described in detail from the technical features disclosed in the present invention.

To attain the objectives, a solution provided by the present invention is: an electrical connector which comprises a plug body, a plurality of plug power terminals and a plurality of plug signal terminals, the plug body has a docking portion in the front and a mounting portion in the rear, the front surface of the docking portion is perpendicular to the bottom surface of mounting portion, a plurality of spacers parallelly extends backward to the mounting portion is formed on the docking portion, and a row of vertical power interfaces is formed between each two adjacent spacers; a plurality of power terminal accommodating passages passes through the back surface and bottom surface of the mounting portion is formed on the mounting portion, and the power terminal accommodating passage is connected to the corresponding power interface; at least one row of vertical signal interfaces is formed on the docking portion, the signal interfaces are parallelly extending backward and a plurality of signal terminal accommodating passages is formed; wherein the signal interfaces are disposed beside the power interfaces and are parallel to the power interfaces;

the plurality of plug power terminals has each of which mounted into the plug body and provided with a tab docking connector, a rear end perpendicular to the docking connector, and a joint connecting the docking connector and the rear end, wherein the docking connector extends into the power interface of the plug body, the joint is fixed in the power terminal accommodating passage of the plug body, and the rear end extends out of the bottom surface of the mounting portion of the plug body; and the plurality of plug signal terminals respectively mounted into the plug body and each provided with a head portion and a rear portion, the head portion of the plug signal terminal extends into the signal interface of the plug body while the rear portion extends out of the bottom surface of the mounting portion of the plug body, the head portions of the plug signal terminals in the signal interfaces are arranged in a straight line vertically, and the rear portions are arranged in a straight line as well and are in a direction perpendicular to that of the head portions.

In an embodiment of the present invention, a guiding rib protruding toward the corresponding power interface is formed on each of the spacers.

In an embodiment of the present invention, each of the docking portion and mounting portion is provided with a plurality of opening holes which are respectively connected with the corresponding power interfaces and power terminal accommodating passages.

In an embodiment of the present invention, the plug power terminals are divided into two types, wherein the first type of plug power terminal is larger than the second type of plug power terminal in structural size, two of the first type of plug power terminals are combined as a first group while two of the second type of plug power terminals are combined as a second group, and each of the rows of power interfaces, accommodates the first group and second group of plug power terminals at the same time; and In an embodiment of the present invention, the plug signal terminal is an independent plug signal terminal module formed by integrating with a plastic body, the head portion of the plug signal terminal is extended out of the front end of the plug signal terminal module while the rear portion is extended out of the bottom surface of the plug signal terminal module.

To attain the objectives, another solution provided by the present invention is: an electrical connector which comprises a receptacle body, a plurality of receptacle power terminals and a plurality of receptacle signal terminals.

the receptacle body has a substrate, a plurality of power terminal accommodating holes passes through the upper and bottom surfaces of the substrate as well as a plurality of signal terminal accommodating holes being arranged in a straight line beside the power terminal accommodating holes and are formed on the substrate, at least one inserting bar protruding upward and at least one parallel stopping plate extending upward and parallel to the inserting bar are formed in the upper surface of the substrate; both the inserting bar and the stopping plate are perpendicular to the substrate, at least one row of long power slots is formed in the top surface of the inserting bar, and the power slots extend downward to the upper surface of the substrate and connect to the power terminal accommodating holes; the stopping plate is disposed at one side of the inserting bar, a long signal slot is formed in the stopping plate and is parallel to the power slot and extending downward to the upper surface of the substrate and connecting to the signal terminal accommodating hole;

a plurality of receptacle power terminals respectively mounted into the receptacle body and each provided with a mounting section, an arc docking section extending upward from the mounting section, and a fixing leg extending downward from the mounting section, wherein the mounting section is fixed into the power terminal accommodating hole of the substrate, the docking section is extended into the power slot, and the fixing leg is extended out of the bottom surface of the substrate; and the receptacle signal terminal is mounted into the receptacle body and having bead portion extended into the signal slot while rear portion extended downward out of the bottom surface of the substrate.

In an embodiment of the present invention, an opening hole is formed in each of the two ends of the inserting bar, the opening hole is connected to the power slot.

In an embodiment of the present invention, a guiding groove is formed in each of the two external side walls of the inserting bar, the guiding groove is extended vertically from the top end of the inserting bar to the upper surface of the substrate.

In an embodiment of the present invention, the receptacle power terminals are mounted into the power slots in pairs, and two pairs of receptacle power terminals are mounted into each of the power slots, and the docking sections of each pair of receptacle power terminals are converging.

To attain the objectives, a third solution provided by the present invention is: an electrical connector combination which comprises a first electrical connector parallel mounted onto a first circuit board and a second electrical connector perpendicularly mounted onto a second circuit board, after the docking of the first electrical connector and second electrical connector, the first circuit being perpendicular to the second circuit board, the first electrical connector comprises a plug body, a plurality of plug power terminals, and a plurality of plug signal terminals; wherein the plug body has a docking portion in the front and a mounting portion in the rear, the front surface of the docking portion is perpendicular to the bottom surface of the mounting portion, the bottom surface of the mounting portion is disposed on the first circuit board, a plurality of spacers parallel and backward extends to the mounting portion, and a row of vertical power interfaces is formed between each two adjacent spacers; at least a row of vertical signal interfaces is also formed on the docking portion; wherein the signal interfaces are disposed beside the power interfaces and are parallel to the power interfaces; each of the plug power terminals is mounted into the plug body, and having docking connector extended into the power interface of the plug body and rear end extended out of the bottom surface of the mounting portion of the plug body; and each of the plug signal terminal is mounted into the plug body, and having a head portion extended into the signal interface of the plug body while a rear portion extended out of the bottom surface of the mounting portion of the plug body, the heard portions of the plug signal terminals in the signal interfaces are arranged in a straight line vertically while the rear portions are arranged in a straight line and in a direction perpendicular to that of the head portions;

the second electrical connector comprises a receptacle body, a plurality of receptacle power terminals, and a plurality of receptacle signal terminals, wherein the receptacle body is provided with a substrate, and at least one inserting bar protruding upward and at least one stopping plate extending upward and parallel to the inserting bar; both the inserting bar and the stopping plate are perpendicular to the substrate, and at least one row of long power slots is formed in the top surface of the inserting bar; the stopping plate is disposed beside the inserting bar, a signal slot is formed on the stopping plate, and the signal slot is parallel to the power slot; the receptacle power terminals have each of which mounted into the receptacle body and docking section extended into the power slot while a fixing leg extended out of the bottom surface of the substrate; the receptacle signal terminals are mounted into the receptacle body and each have head portion extended into the signal slot while a rear portion extended downward out of the bottom surface of the substrate;

wherein during docking, the second electrical connector has inserting bar inserted into the corresponding power interface of the first electrical connector, and the plug power terminal has docking connector inserted into the corresponding power slot and forms an electrical contact with the corresponding docking section of the receptacle power terminal; the plug signal terminal of the first electrical connector has signal interface inserted into the signal slot of the second electrical connector, so that the receptacle signal terminal is inserted into the corresponding signal interface and forms an electrical connection with the corresponding plug signal terminal.

In an embodiment of the present invention, a guiding groove is disposed on the two sides of the inserting bar while a guiding rib is disposed on the two internal side walls of the power interface, and the inserting bar is inserted into the corresponding power interface through the fitting of the guiding groove to the guiding rib; and In an embodiment of the present invention, a plurality of opening holes connecting to the corresponding power interfaces is disposed in the docking portion, and an opening hole connected to the power slot is formed in each of the two ends of the inserting bar; after the docking of the first electrical connector and the second electrical connector, the opening holes in the docking portion of the first electrical connector are respectively directed at each of the opening holes in the inserting bar of the second electrical connector.

Compared with conventional technologies, by disposing a vertical power interface on the plug body and a vertical signal interface at one side of the power interface according to the present invention, both the plug power terminals and the plug signal terminals can be respectively ranged straight in line vertically thereby saving the edge space of a circuit. Likewise, a power slot and a signal slot that are parallel to each other are also disposed on the receptacle body, therefore the receptacle power terminals and receptacle signal terminals can be respectively ranged straight in line thereby forming a compact structure and enabling the edge of the circuit board to be disposed with more connector sockets of the same type or other types. Besides, by the designing of the opening holes that improve the internal system air circulation, the electrical connector combination according to the present invention is operable to create an efficient electrical transmission and distribution in a board to board configuration. Furthermore, by the structural designing of the guiding groove and guiding rib, the electrical connector and the combination thereof is provided with certain are provided with certain convenience in assembling.

DETAILED DESCRIPTION OF THE INVENTION

Figure 1:
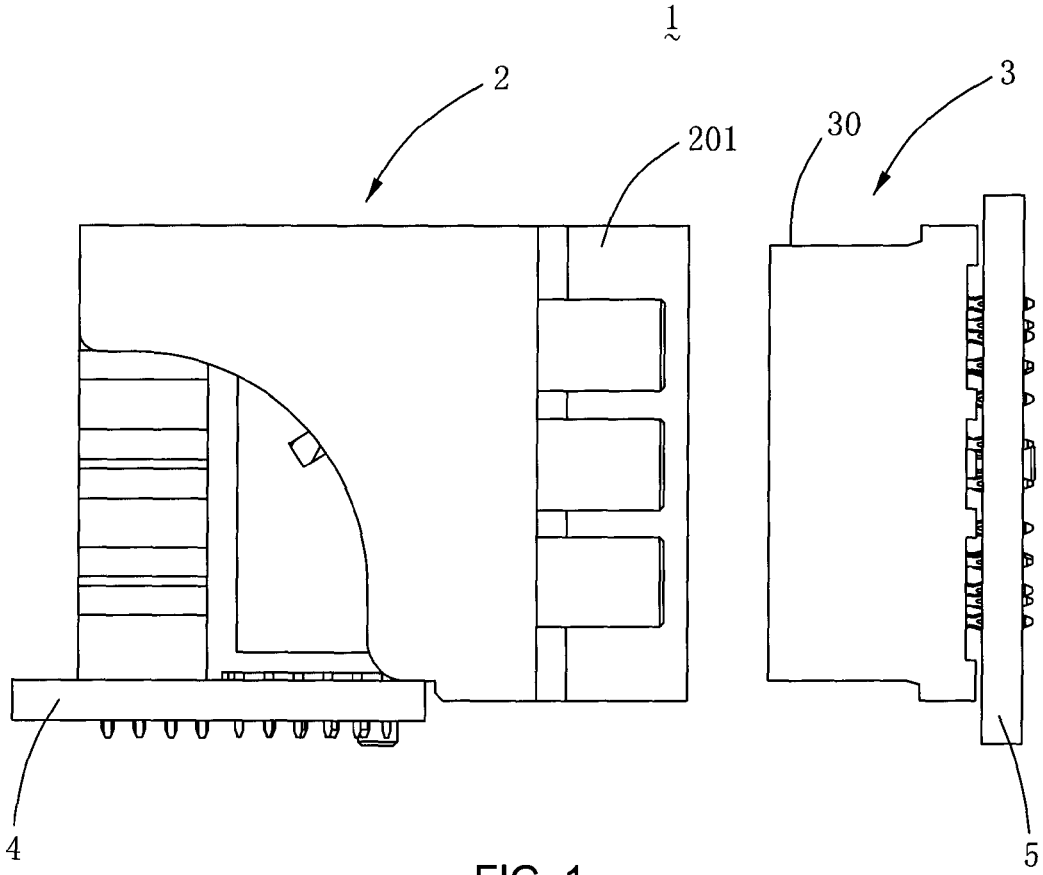
FIG. 1 is a flat structure diagram of an electrical connector combination according to the present invention, wherein a first electrical connector and a second electrical connector are both arranged on the circuit board and the positioning relationship before docking is illustrated.

The following description is explained in conjunction with accompanying drawings to illustrate rather than limit the present invention.

Please refer to FIGS. 1, 2, 3 and 7, the electrical connector combination 1 according to the present invention includes a first electrical connector 2 being parallelly mounted on a first circuit board 4 and a second electrical connector 3 being perpendicular mounted on a second circuit board 5, both the first and the second electrical connector 2, 3 are of a mixed interface while being provided with power and signal transmission capabilities. In the present example, the first electrical connector 2 is an orthogonal plug connector whose plugging direction is parallel to the first circuit board 4, and the second electrical connector 3 is a vertical receptacle connector whose receiving direction is perpendicular to the second circuit board 5.

Please refer to FIGS. 3 to 6, the first electrical connector 2 according to the present invention includes a plug body 20, a plurality of plug power terminals 21 and a plurality of plug signal terminals 22, wherein the plug body 20 is provided with a docking portion 201 disposed in the front and a mounting portion 202 disposed in the rear, the front surface of the docking portion 201 is perpendicular to the bottom surface of the mounting portion 202, when the first electrical connector 2 is mounted onto the first circuit board 4, the bottom surface of the mounting portion 202 is disposed on the first circuit board 4, and that the docking portion and the front surface thereof extends out of the edge of the first circuit board to be docked to the receptacle connector.

Please refer to FIGS. 3 to 6, a plurality of spacers 23 extending parallel from the front surface of the docking portion 201 backward to the mounting portion 202 is formed on the docking portion 201, a row of vertical power interfaces 24 is formed on the front surface of the docking portion 201 and between two adjacent spacers 23, and each of the row of power interfaces 24 is extending backward to the mounting portion 202.

Please refer to FIGS. 3 to 6, a plurality of power terminal accommodating passages passing through the rear and bottom surfaces of the mounting portion 202 is formed on the mounting portion 202 so as to accommodate the plug power terminals 21. The power terminal accommodating passages are connected to the corresponding power interfaces 24.

Please refer to FIGS. 3 to 6, a row of signal interfaces 25 is also formed on the docking portion 201, the row of signal interfaces 25 is disposed at the power interfaces 24 and is parallel to the same. This row of signal interfaces 25 is extending parallelly and backward to the mounting portion 202, thereby a plurality of signal accommodating passages is formed to accommodate the plug signal terminals 22.

Please refer to FIGS. 3 to 6, a semi-enclosed accommodating space 203 defined by an external side wall of the mounting portion 202 and the separative plate 23 close thereto is formed on the mounting portion 202 (please also refer to FIG. 5A), which is connected to the signal terminal accommodating passages. In the present embodiment, an arc opening 204 in the external side wall of the mounting portion 202 to provide mounting space for the plug signal terminals 22 so that the plug signal terminals 22 can be accommodated into the accommodating space 203 successfully.

In the present embodiment, the amount of the separative plate 23 is three, hence, two rows of the parallel power interfaces 24 can be formed. Besides, the amount of this row of signal interfaces 25 is six and an independent body is formed by every two closing signal interfaces 25, hence, there are three independent bodies altogether.

In the present embodiment, a guiding rib 230 protruding towards the power interface 24 is formed on each of the separative plate 23, and the guiding rib 230 is extending backward in a straight line, so as to provide guidance for the docking with the receptacle connector (please also refer to the second electrical connector 3).

In the present embodiment, a plurality of opening holes 205 is disposed in the top and bottom surfaces of the docking portion 201, each of which is respectively connecting to the corresponding power interface 24. Besides, a plurality of opening holes 206 is also arranged in the top surface of the mounting portion 202 to be connected to the corresponding power terminal accommodating passage. By the arranging of the opening holes 205, 206, the internal air circulation of the plug body 20 is improved, thereby improving the heat dissipation and protecting the power devices or electronic devices.

Figure 5A:
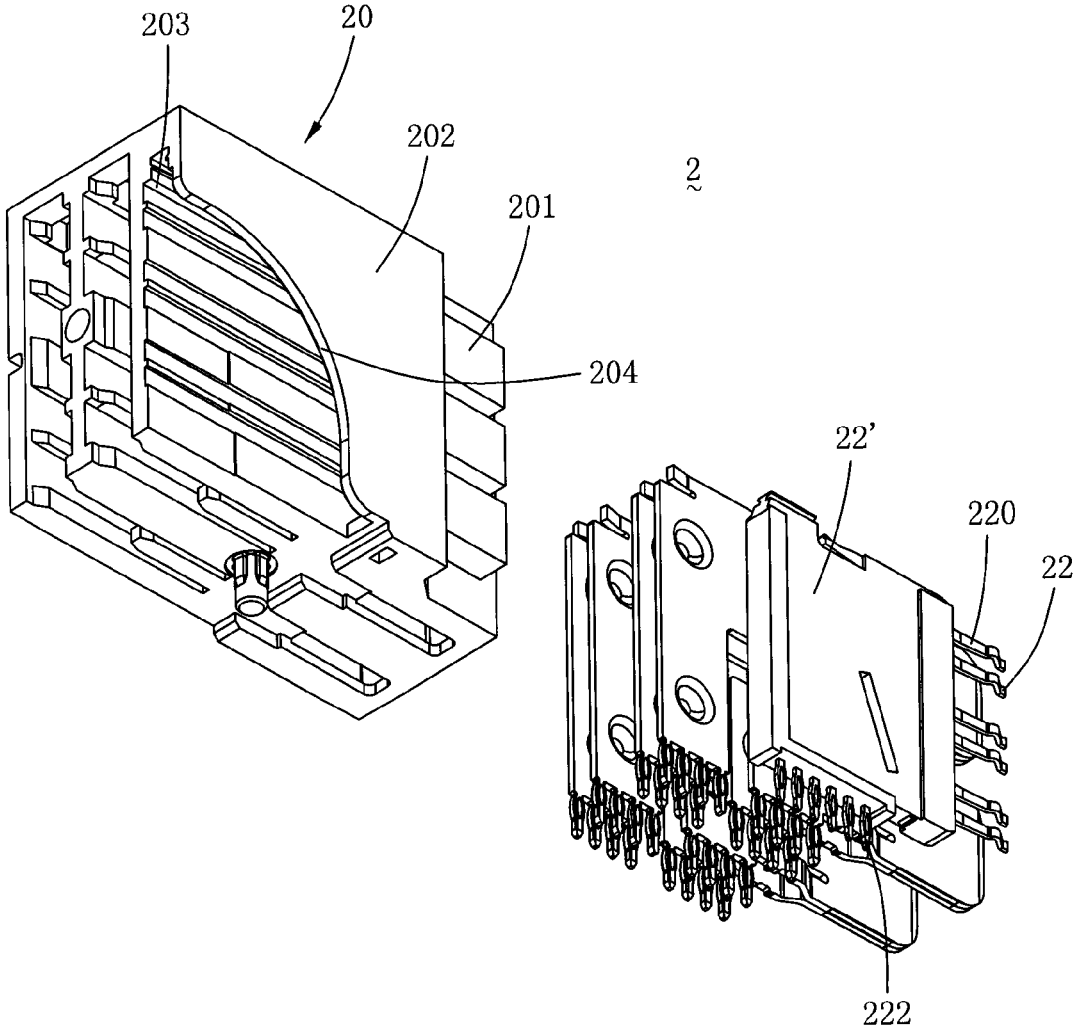
FIG. 5A is an exploded view of the first electrical connector according to the present invention.
Figure 5B:
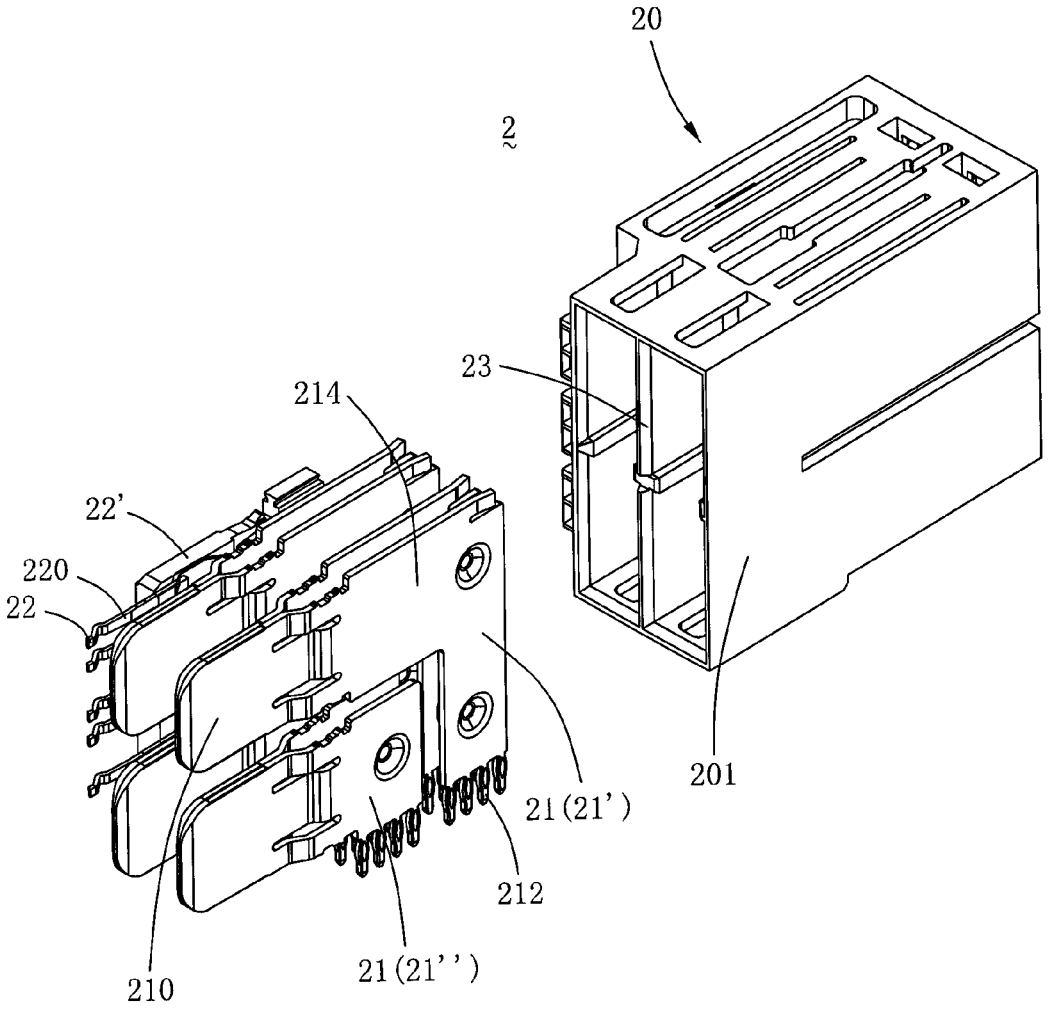
FIG. 5B is an exploded view of the first electrical connector from another angle according to the present invention.

Please refer to FIGS. 5A and 5B, the plug power terminal 21 of the first electrical connector 2 is mounted in the plug body 20, each of the plug power terminals 21 is provided with a tab docking connector 210, a rear end 212 perpendicular to the docking connector 210, and a joint 214 connecting the docking connector 210 and the rear end 212, wherein the docking connector 210 extends into the power interface of the plug body 20, the joint 214 is fixed into the power terminal accommodating passage of the plug body 20, and the rear end 212 extends out of the bottom surface of the mounting portion 202 of the plug body 20 so as to facilitate the connection to the power access point (not shown) on the first circuit board. In the present embodiment, the rear end 212 of the plug power terminal 21 is punctured and is fixed to the electrical guiding holes by being pressed and jointed, so as to be connected to the power access point on the first circuit board 4.

In the present embodiment, there are two kinds of plug power terminals 21, wherein the first kind of plug power terminals 21' is shaped high and long while the second kind of plug power terminals 21" is shaped low and short. These two kinds of plug power terminals 21', 21" are generally identical in structure except for their size. During practical assembling, two of the first kind of plug power terminals 21' are combined as group one and two of the second kind of plug power terminals 21" are combined as group two, every row of power interfaces 24 is required to accommodate the two groups of plug power terminals 21 (21' and 21"), that is, within every row of power interfaces 24, two combined first kind of plug power terminals 21' as well as two combined second kind of plug power terminals 21" are accommodated. This arrangement guarantees that the docking connectors 210 of the plug power terminals 21 within the same row of power interfaces 24 are ranged straight in line vertically (please also refer to FIG. 6) while whose rear ends 212 can be configured to range parallel into two rows based on the circuit layout on the first circuit board 4.

Figure 6:
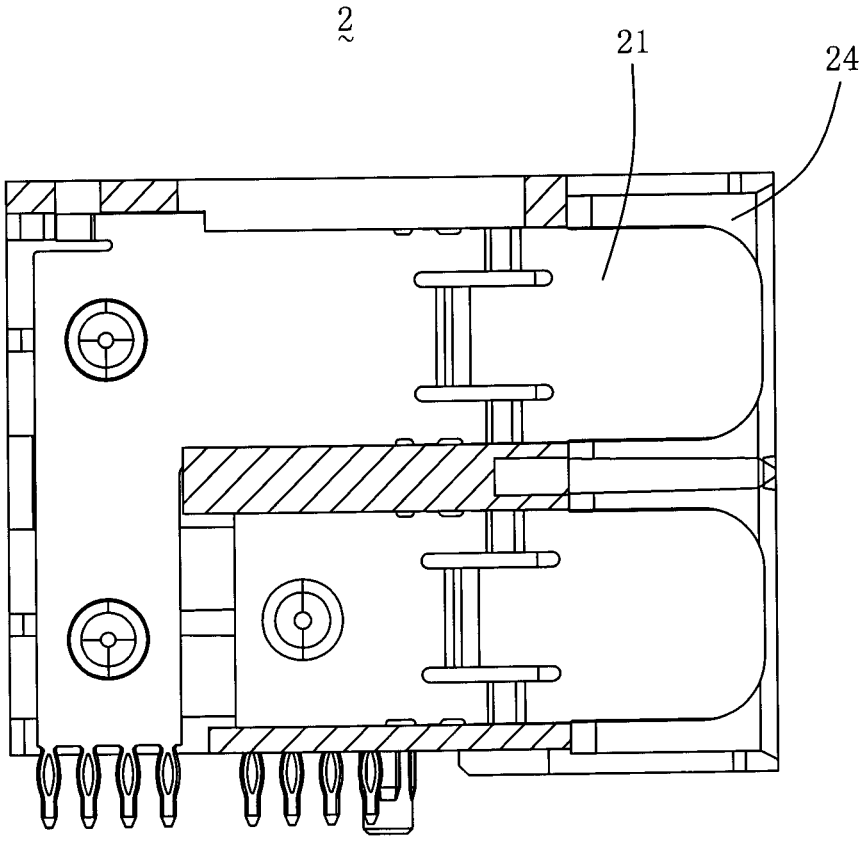
FIG. 6 is a cross-sectional view along A-A' according to FIG. 3.

Please refer to FIG. 6, the plug signal terminal 22 of the first electrical connector 2 according to the present invention is mounted in the plug body 20, each of the plug signal terminal 22 is provided with a head portion 220 and a rear portion 222. In the present embodiment, the plug signal terminal 22 is mounted into the plug body as terminal module, namely, the plug signal terminal 22 and the plastic body form an independent plug signal terminal module 22' by integrating, the head portion 220 of the plug signal terminal 22 extends out of the front end of the module 22', and the rear portion 222 extends and exposes at the bottom surface the module 22'. Please also refer to FIG. 4, the head portion 220 of the plug signal terminals 22 in the same row are ranged straight in line vertically while the rear portions 222 are ranged straight in line according to the circuit layout on the first circuit board 4, this shows that the rear portions 222 are ranged in a direction that is perpendicular to that of the head portions 220. When the plug signal terminal 22 is assembled onto the plug body 20 as module 22', the plug signal terminal module 22' is actually accommodated in the accommodating space 203 of the mounting portion 202 of the plug body 20, and the head portion 220 of the plug signal terminal 22 extends into the signal interface 25, also the rear portion 222 of the plug signal terminal 22 extends out of the bottom surface of the mounting portion 202 of the plug body 20 so as to facilitate the connection to the signal access point (not shown) on the first circuit board 4. Please also refer to FIGS. 3 and 4, the rear portions 222 of the plug signal terminals 22 are actually ranged straight in line at one side of the array that is formed by the rear ends 212 of the plug power terminals 21. In the present embodiment, the rear portion 222 of the plug signal terminal 22 is punctured and is fixed into the corresponding electrical guiding hole of the first circuit board by being pressed and jointed, so as to be connected to the signal access point on the first circuit board 4.

In the present embodiment, the plug signal terminals 22 are counted six.

Please refer to FIGS. 7 to 10, the second electrical connector 3 according to the present invention comprises a receptacle body 30, a plurality of receptacle power terminals 31 and a plurality of receptacle signal terminals 32, wherein the receptacle body 30 is provided with a substrate whose bottom surface 33 is located on the second circuit board 5, and a plurality of power terminal accommodating holes 330 penetrating the top and bottom surfaces of the substrate 33 as well as a plurality of signal terminal accommodating holes 332 being arranged in a straight line beside the power terminal accommodating holes 330 are formed on the substrate 33. In the top surface of the substrate 33, at least one up-protruding inserting bar 34 and at least one up-extending stopping plate 35.

Figure 7:
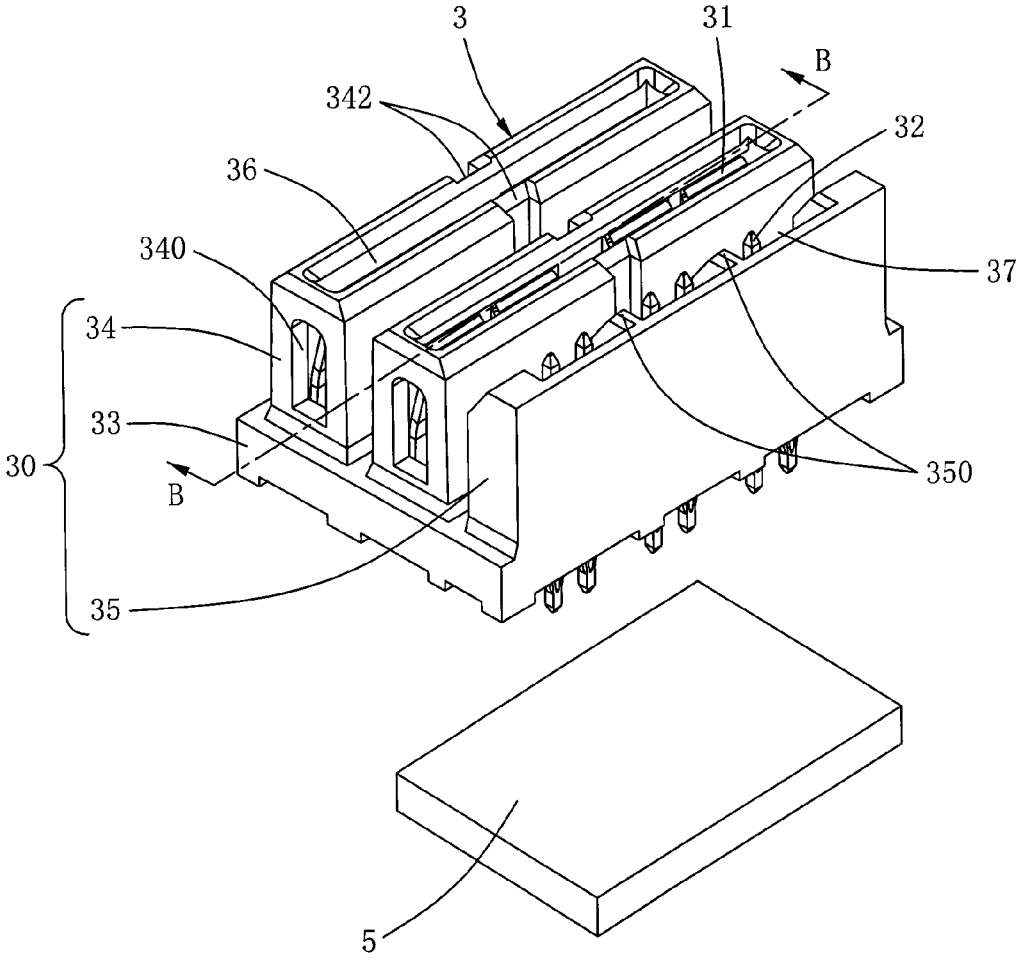
FIG. 7 is a space diagram of the second electrical connector and the second circuit board according to the present invention.
Figure 8:
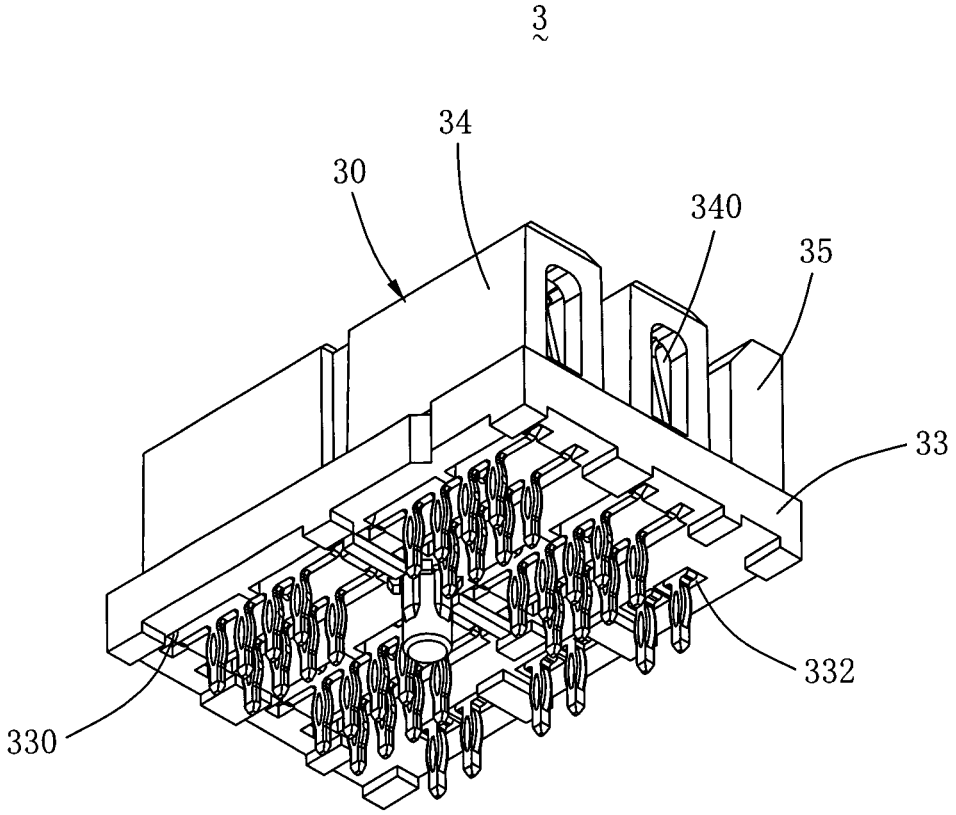
FIG. 8 is a space diagram of the second electrical connector from another angle according to the present invention.
Figure 10:
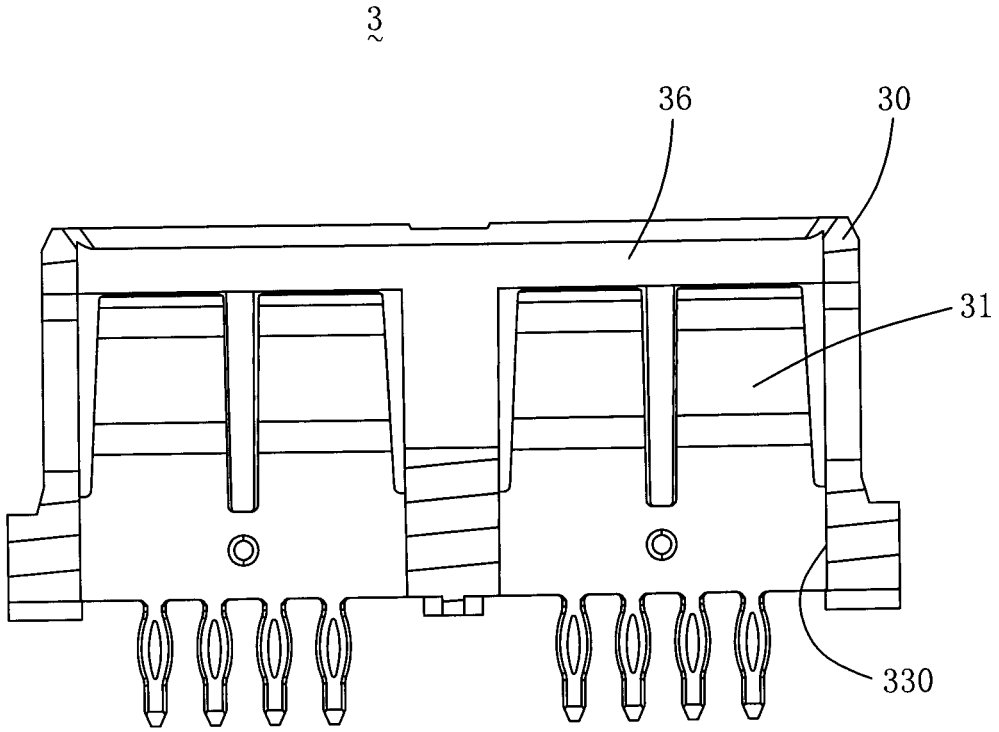
FIG. 10 is a cross-sectional view along B-B' according to FIG. 7.

As illustrated in FIGS. 7 and 10, both the inserting bar 34 and the stopping plate 35 are perpendicular to the substrate 33, a row of long power slots 36 is formed in the top surface of the inserting bar 34, and the power slots 36 extend downward to the upper surface of the substrate 33 and is connected to the power terminal accommodating holes 330, please also refer to FIG. 10.

As illustrated in FIG. 7, the stopping plate 35 is located at one side of the inserting bar 34, a semi-enclosed long signal slot 37 is formed on the stopping plate 35, which is parallel to the power slot 36 and is extended downward to the upper surface of the substrate 33 and connected to the signal terminal accommodating holes 332.

In the present embodiment, the inserting bars 34 are counted two, hence, two parallel rows of power slots 36 can be formed. Two spacers 350 are formed in the signal slot 37 of the stopping plate 35, thereby dividing the signal slot 37 into three sections so as to correspond to the three independent bodies of the signal interfaces 25 on the plug connector.

In one of the embodiment, an opening hole 340 is formed on each of the two ends of the inserting bar 34, the opening hole 340 is connected to the power slot 36, so that the internal air circulation of the receptacle body 30 is improved and thereby improving the heat dissipation and protecting power devices or electronic devices.

In one of the embodiments, a guiding groove 342 is formed on each of the two ends of the inserting bar 34, the guiding groove 342 extends to the upper surface of the substrate 33 from the straight line at the top of the external side wall of the inserting bar 34. The guiding groove 342 is corresponding to the guiding rib 230 in the plug body 20 of the first electrical connector, so that the two can be matched accurately during docking and the plug power terminal 21 is guided and correctly inserted into the power slot 36 of the inserting bar 34, thereby forming an accurate electrical connection with the receptacle power terminal 31.

Figure 9:
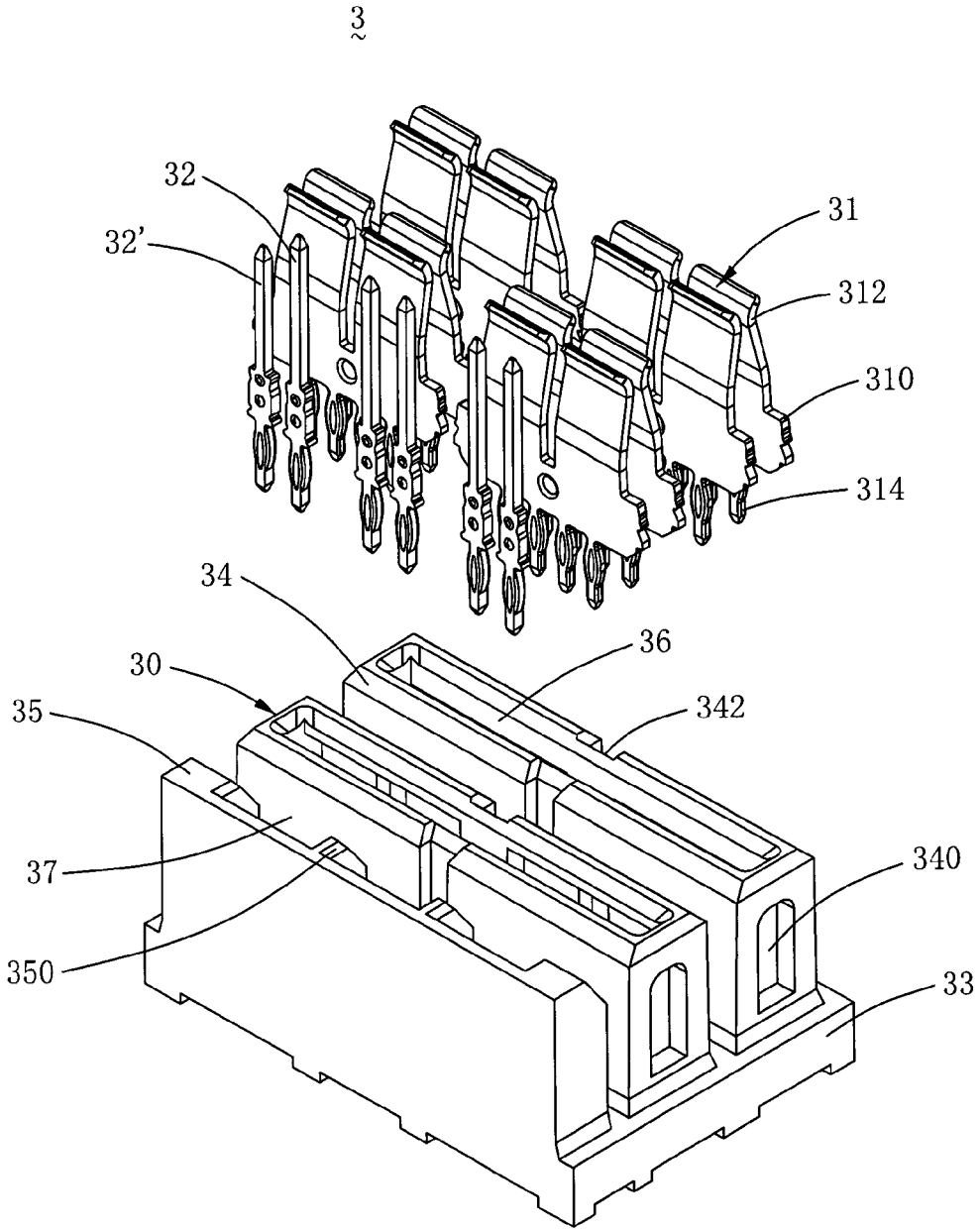
FIG. 9 is an exploded view of the second electrical connector according to the present invention.

Please refer to FIGS. 7 and 9, the receptacle power terminal 31 of the second electrical connector 3 according to the present invention is mounted in the receptacle body 30, each of the receptacle power terminal 31 is provided with a mounting section 310, an arc docking section 312 extending upward from the mounting section 310, and a fixing leg 314 extending downward from the mounting section 310, wherein the mounting section 310 is assembled into the power terminal accommodating holes 330 of the substrate 33, the docking section 312 is extended into the power slot 36, and the fixing leg 314 is extended out of the bottom surface of the substrate 33 so as to facilitate a fixed connection to the power access point on the second circuit board 5. In other embodiments, the fixing leg 314 can be needle-like or other shapes without any punctures, and being electrically connected to the power access point of the second circuit board 5 by welding.

In the present invention, the receptacle power terminals 31 are mounted into the power slots 36 in pairs, and within each of the power slots 36, two pairs of receptacle power terminals 31 are installed. The docking sections 312 of each of the pair of receptacle terminals 31 are converging to each other so as to engage the plug power terminal 21 inserted therein, thereby creating a reliable electrical connection result.

Please refer to FIGS. 7 and 9, the plug signal terminal 32 of the second electrical connector 3 according to the present invention is mounted into the receptacle body 30, and the ranging of the receptacle signal terminals 32 is parallel to that of the receptacle power terminals 31. Wherein the head of the receptacle signal terminal 32 is extended into the signal slot 37 while the rear is extended out of the bottom surface of the substrate 33 to facilitate being pressed and jointed to the corresponding guiding hole, so as to enable a connection to the signal access point on the second circuit board 5.

Figure 2:
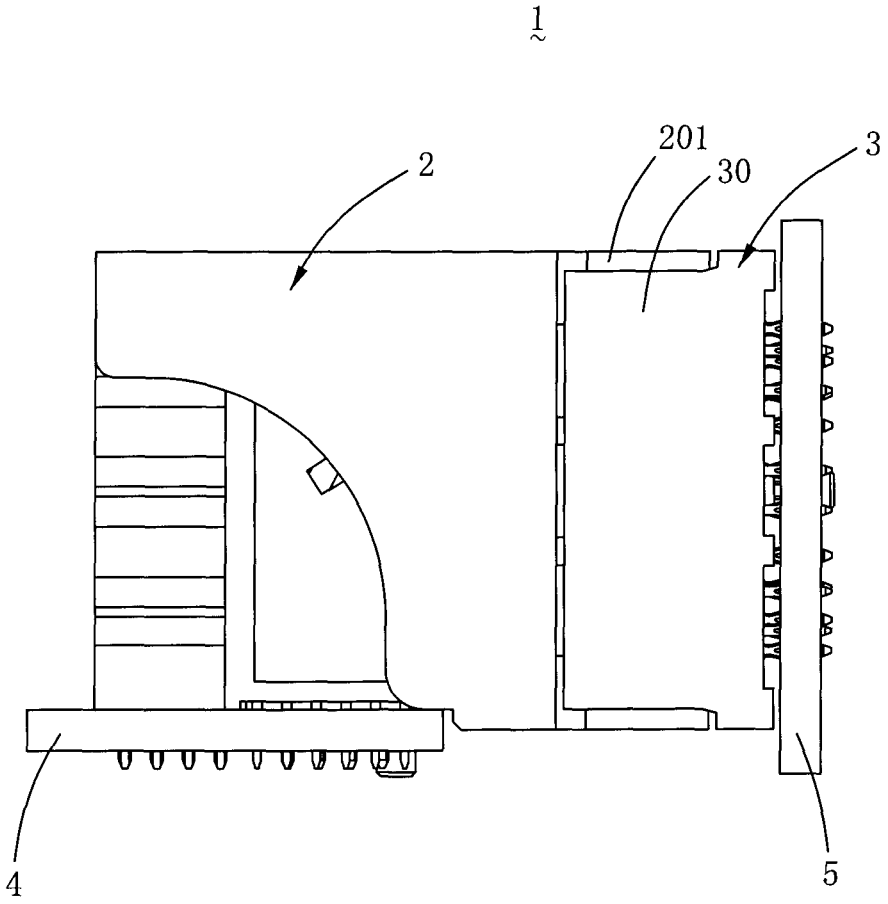
FIG. 2 is a structure diagram of the electrical connector combination according to the present invention, wherein the positioning relationship of the first electrical connector and second electrical connector after docking is illustrated.
Figure 11:
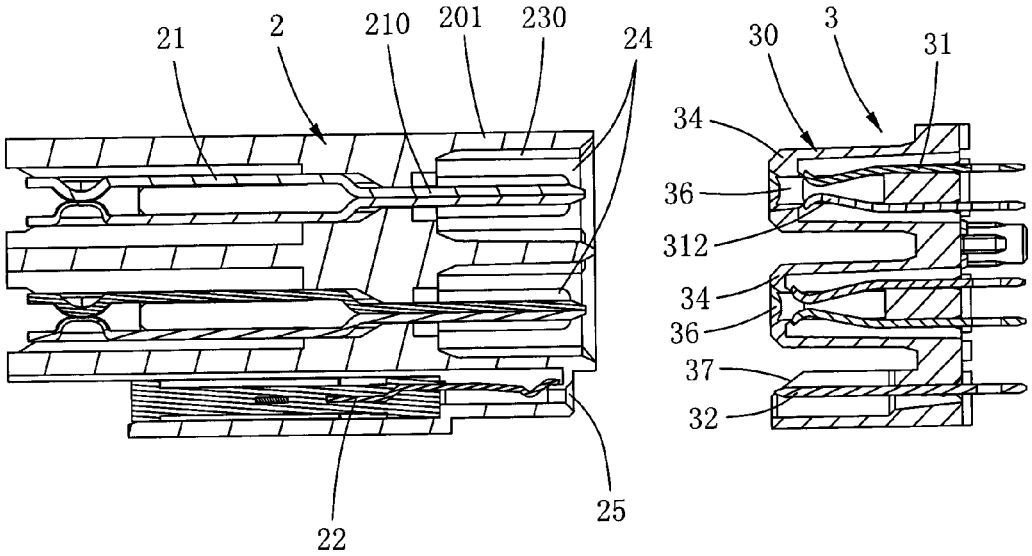
FIG. 11 is an internal structure diagram of the electrical connector combination according to the present invention, wherein the internal structure of the first electrical connector and the second electrical connector is illustrated.

Please refer to a structure diagram of the electrical connector 1 illustrated in FIGS. 1, 2 and 11, wherein the FIG. 11 particularly displayed the internal structure of the first electrical connector 2 and second electrical connector 3 before being docked. The process of the docking of the first electrical connector 2 and second electrical connector 3 to form an electrical connector combination 1 is as follows.

Figure 3:
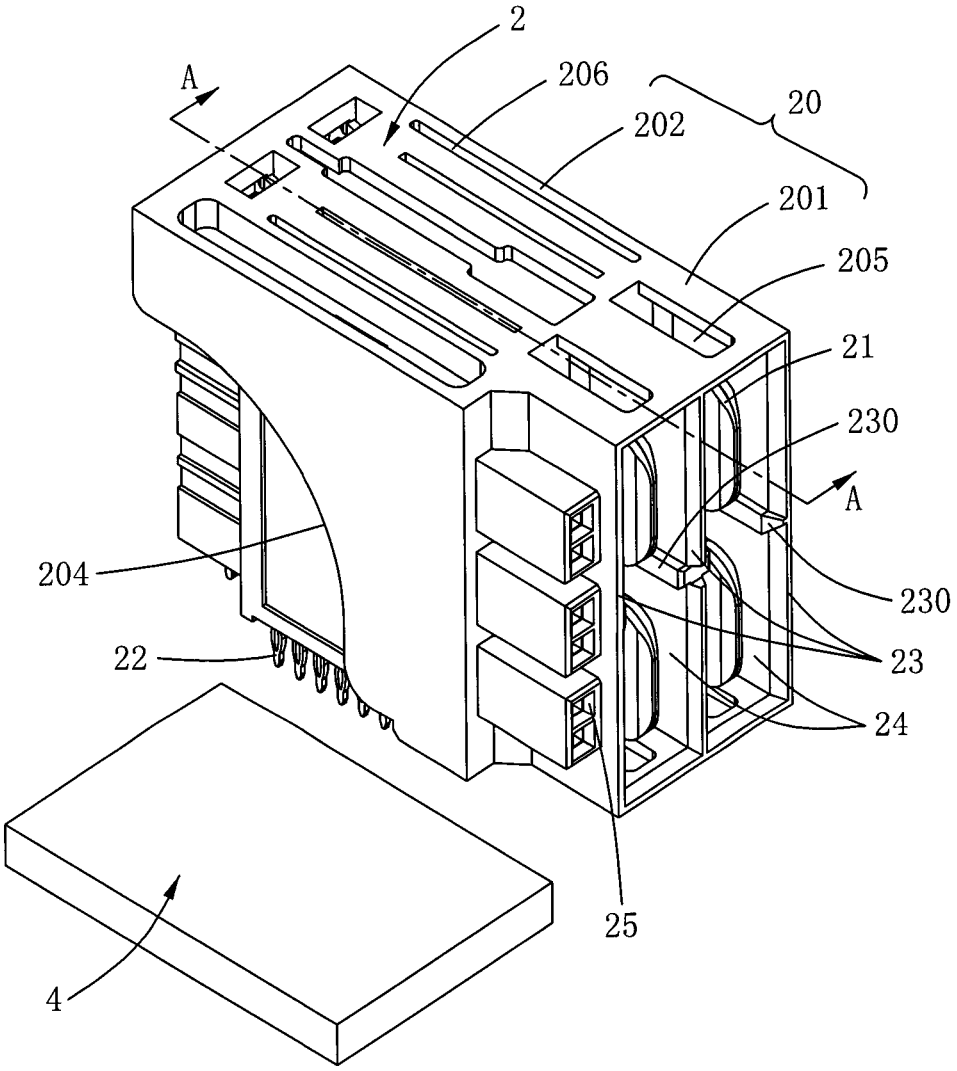
FIG. 3 is a space diagram of the first electrical connector and the first circuit board according to the present invention.
Figure 4:
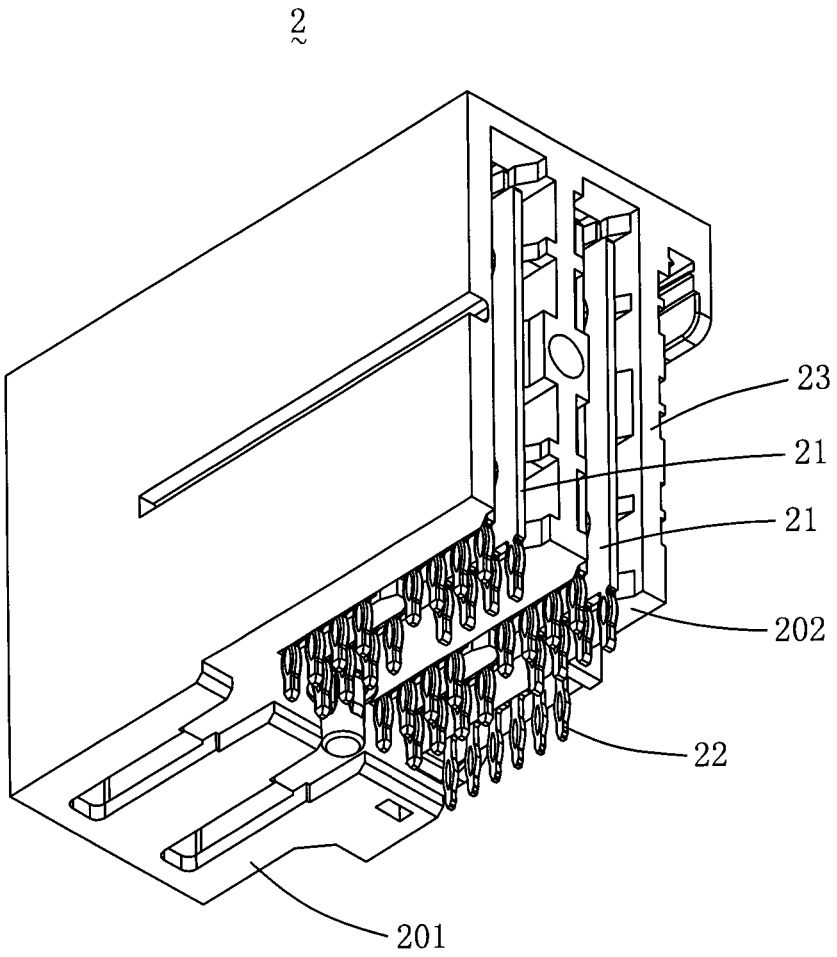
FIG. 4 is a space diagram of the first electrical connector from another angle according to the present invention.

The docking portion 201 of the first electrical connector 2 is directed toward the receptacle body 30 of the second electrical connector, wherein the two rows of power interfaces 24 of the first electrical connector 2 are directed at the two inserting bars 34 of the second electrical connector 3, each of the inserting bars 34 can be respectively inserted into a corresponding power interface 24, and by the fitting of the guiding grooves 342 at the two sides to the guiding ribs 230 at the two sides of the power interfaces 24, the inserting bars 34 are successfully guided and inserted into the power interfaces 24. Now, the docking connector 210 of a group of plug power terminals 21 are inserted into between the arc docking sections 312 of two receptacle power terminals 31 through the power slot 36 and are engaged between the two arc docking sections 312, thereby creating a reliable electric power transmission channels. At the same time, as the signal interface 25 of the plug signal terminal 22 is directed at the signal slot 37 of the second electrical connector 3, the receptacle signal terminal 32 can be inserted into the corresponding signal interface 25 accurately and be successfully docked with the plug signal terminal 22, thereby creating a signal transmission channel. In addition, after the first electrical connector 2 is docked with the second electrical connector 3, the opening holes 205 (as shown in FIG. 3) in the top and bottom surfaces of the docking portion 201 of the first electrical connector 2 can be accurately directed at the opening holes 340 (as shown in FIG. 9) in the two ends of the inserting bars 34 of the second electrical connector 3, so that the internal airflow in the electrical connector combination 1 is connected to the external to improve air circulation, thereby improving heat dissipation and increasing the efficiency of the electrical connector combination.

Additionally, in the present invention, the plug signal terminal 22 of the first electrical connector 2 is slightly shorter than the plug power terminal 21, therefore, the power line is connected before the signal line do. Also, one of the receptacle signal terminals 32' (as shown in FIG. 9) can be designed to be slightly shorter than other receptacle signal terminals 32 so as to provide switching capability, so that the electrical connector combination 1 can better meet the safety need of an electronic device.

All in all, the electrical connector 2, 3 according to the present invention is designed to be thin and tall, which can not only save the edge space of the circuit board 4, 5 and thus enable the edges of circuit board 4, 5 to be disposed with more connector sockets of same or other kinds, but can also, by the design of opening holes 205, 206, 340 that improving the system air circulation in the power system, create efficient power transmission and distribution in the board-to-board configuration. Moreover, by designing the structure of the guiding groove 342 and guiding ribs 230, the electrical connector and the combination thereof are provided with certain convenience in assembling.

What is claimed is:

1. An electrical connector comprising:

a plug body having a docking portion in the front and a mounting portion in the rear, the front surface of the docking portion being perpendicular to the bottom surface of mounting portion, a plurality of spacers parallelly extending backward to the mounting portion being formed on the docking portion, and a row of vertical power interfaces being formed between each two adjacent spacers; a plurality of power terminal accommodating passages passing through the back surface and bottom surface of the mounting portion being formed on the mounting portion, and the power terminal accommodating passage being connected to the corresponding power interface; at least one row of vertical signal interfaces being formed on the docking portion, the signal interfaces being parallelly extending backward and a plurality of signal terminal accommodating passages being formed; wherein the signal interfaces are disposed beside the power interfaces and are parallel to the power interfaces;

a plurality of plug power terminals respectively mounted into the plug body and each provided with a tab docking connector, a rear end perpendicular to the docking connector, and a joint connecting the docking connector and the rear end, wherein the docking connector extends into the power interface of the plug body, the joint is fixed in the power terminal accommodating passage of the plug body, and the rear end extends out of the bottom surface of the mounting portion of the plug body; and a plurality of plug signal terminals respectively mounted into the plug body and each provided with a head portion and a rear portion, the head portion of the plug signal terminal extending, into the signal interface of the plug body while the rear portion extending out of the bottom surface of the mounting portion of the plug body, the head portions of the plug signal terminals in the signal interfaces being arranged in a straight line vertically, and the rear portions being arranged in a straight line and in a direction perpendicular to that of the head portions;

wherein the plug power terminals are divided into two types, the first type of plug power terminal is larger than the second type of plug power terminal in structural size, two of the first power terminals are combined as a second group, and each of the rows of power interfaces accommodates the first group and second group of plug power terminals at the same time; and the plug signal terminal is an independent plug signal terminal module formed by integrating with a plastic body, the head portion of the plug signal terminal is extended out of the front end of the plug signal terminal module while the rear portion is extended out of the bottom surface of the plug signal terminal module.

2. The electrical connector as claimed in claim 1, wherein a guiding rib protruding toward the corresponding power interface is formed on each of the spacers.

3. The electrical connector as claimed in claim 1, wherein each of the docking portion and mounting portion is provided with a plurality of opening holes which are respectively connected with the corresponding power interfaces and power terminal accommodating passages.

4. An electrical connector combination comprising a first electrical connector parallelly mounted onto a first circuit board and a second electrical connector perpendicularly mounted onto a second circuit board, after the docking the first electrical connector and second electrical connector, the first circuit being perpendicular to the second circuit board, the first electrical connector comprising a plug body, a plurality of plug power terminals, and a plurality of plug signal terminals; wherein the plug body has a docking portion in the front and a mounting portion in the rear, the front surface of the docking portion is perpendicular to the bottom surface of the mounting portion, the bottom surface of the mounting portion is disposed on the first circuit hoard, a plurality of spacers parallelly and backward extends to the mounting portion, and a row of vertical power interfaces is formed between each two adjacent spacers; at least a row of vertical signal interfaces being also formed on the docking portion; wherein the signal interfaces are disposed beside the power interfaces and are parallel to the power interfaces; each of the plug power terminals being mounted into the plug body, and having docking connector extended into the power interface of the plug body and rear end extended out of the bottom surface of the mounting portion of the plug body, and each of the plug signal terminal being mounted into the plug body, and having a head portion extended into the signal interface of the plug body while a rear portion extended out of the bottom surface of the mounting portion of the plug body, the heard portions of the plug signal terminals in the signal interfaces being arranged in a straight line vertically while the rear portions being arranged in a straight line and in a direction perpendicular to that of the head portions;

the second electrical connector comprising a receptacle body, a plurality of receptacle power terminals, and a plurality of receptacle signal terminals, wherein the receptacle body is provided with a substrate, and at least one inserting bar protruding upward and at least one stopping plate extending upward and parallel to the inserting bar; the inserting bar and the stopping plate being perpendicular to the substrate, and at least one row of long, power slots being formed in the top surface of the inserting bar; the stopping plate being disposed beside the inserting bar, a signal slot being formed on the stopping plate, and the signal slot being parallel to the power slot; the receptacle power terminals respectively mounted into the receptacle body and docking section extended into the power slot while a fixing leg extended out of the bottom surface of the substrate; the receptacle signal terminals being mounted into the receptacle body and each having a head portion extended into the signal slot while a rear portion extended downward out of the bottom surface of the substrate;

wherein during docking, the second electrical connector having inserting bar inserted into the corresponding power interface of the first electrical connector, and the plug power terminal having docking connector inserted, into the corresponding power slot and forms an electrical contact with the corresponding docking section of the receptacle power terminal; the plug signal terminal of the first electrical connector has signal interface inserted into the signal slot of the second electrical connector, so that the receptacle signal terminal is inserted into the corresponding signal interface and forms an electrical connection with the corresponding plug signal terminal.

5. An electrical connector comprising:

a receptacle body having a substrate, a plurality of power terminal accommodating holes passing through the upper and bottom surfaces of the substrate and a plurality of signal terminal accommodating holes being arranged in a straight line beside the power terminal accommodating holes and being formed in the substrate; at least one inserting bar protruding upward and at least one stopping plate extending upward and parallel to the inserting bar being formed in the upper surface of the substrate; the inserting bar and the stopping plate being perpendicular to the substrate, at least one row of long power slots being formed in the top suffice of the inserting bar, and the power slots extending downward to the upper suffice of the substrate and connecting to the power terminal accommodating holes; the stopping plate being disposed at one side of the inserting bar, a long signal slot being formed in the stopping plate, which is parallel to the power slot and extending downward to the upper surface of the substrate and connecting to the signal terminal accommodating hole; a plurality of receptacle power terminals respectively mounted into the receptacle body and each provided with a mounting section, an arc docking section extending upward from the mounting section, and a fixing leg extending downward from the mounting section, wherein the mounting section is fixed into the power terminal accommodating hole of the substrate, the docking section is extended into the power slot, and the fixing leg is extended out of the bottom surface of the substrate;

a plurality of receptacle signal terminals respectively mounted into the receptacle body and each head portion extended into the signal slot while a rear portion extended out of the bottom surface of the substrate.

6. The electrical connector as claimed in claim 5, wherein an opening hole is formed in each of the two ends of the inserting bar, and the opening hole is connected to the power slot.

7. The electrical connector as claimed in claim 5, wherein a guiding groove is formed in each of the two outer walls of inserting bar, the guiding groove is extended vertically from the top end of the inserting bar to the upper surface of the substrate.

8. The electrical connector as claimed in claim 5, wherein the receptacle power terminals are mounted into the power slots in pairs, and two pairs of receptacle power terminals are mounted into each of the power slots, and the docking sections of each pair of receptacle power terminals are converging.

9. The electrical connector combination as claimed in claim 4, wherein a guiding groove is disposed on the two sides of the inserting bar while a guiding rib is disposed on the two outer walls of the power interface, and the inserting bar is inserted into the corresponding power interface through the fitting of the guiding groove to the guiding rib; and a plurality of opening holes connecting to the corresponding power interfaces is disposed in the docking portion, and an opening hole connected to the power slot is formed in each of the two ends of the inserting bar; after docking the first electrical connector and the second electrical connector, the opening holes in the docking portion of the first electrical connector are respectively directed at each of the opening holes in the inserting bar of the second electrical connector.

* * * * *